United States Patent [19]

Cook

[11] 4,427,066

[45] Jan. 24, 1984

[54] OIL RECOVERY METHOD

[75] Inventor: Evin L. Cook, Dallas, Tex.

[73] Assignee: Mobil Oil Corporation, New York, N.Y.

[21] Appl. No.: 487,345

[22] Filed: Apr. 21, 1983

Related U.S. Application Data

[63] Continuation of Ser. No. 261,824, May 8, 1981, abandoned.

[51] Int. Cl.[3] ..... E21B 43/243

[52] U.S. Cl. ..... 166/261; 166/263

[58] Field of Search ..... 166/256, 261, 263

[56] References Cited

U.S. PATENT DOCUMENTS

| | | | |
|---|---|---|---|
| Re. 30,219 | 6/1979 | Lindquist | 166/261 X |
| 2,390,770 | 12/1945 | Barton et al. | 166/261 X |
| 3,064,728 | 11/1962 | Gould | 166/263 X |
| 3,072,185 | 1/1963 | Bond et al. | 166/261 |
| 3,174,543 | 3/1965 | Sharp | 166/261 X |
| 3,434,541 | 3/1969 | Cook et al. | 166/263 X |
| 3,999,606 | 12/1976 | Bandyopadhyay et al. | 166/261 X |
| 4,127,172 | 11/1978 | Redford et al. | 166/261 |
| 4,252,191 | 2/1981 | Pusch et al. | 166/261 |

FOREIGN PATENT DOCUMENTS

| | | | |
|---|---|---|---|
| 1020861 | 11/1977 | Canada | 166/261 |

*Primary Examiner*—George A. Suchfield
*Attorney, Agent, or Firm*—Alexander J. McKillop; James F. Powers, Jr.; Lawrence O. Miller

[57] ABSTRACT

Oil is recovered from an oil-bearing reservoir in a process employing an in-situ combustion process utilizing a combustion-supporting gas containing at least 75% by volume pure oxygen, and preferably substantially pure oxygen, and a sequence in which the production well or wells are cyclically throttled. In place of using an in-situ combustion process, mixtures of steam and carbon dioxide or mixtures of steam and low molecular weight $C_3$–$C_8$ hydrocarbons are injected into the reservoir and the production well is cyclically throttled. The production well flow rate is restricted until the bottom-hole pressure of the well has increased to an amount of about 30% to about 90% of the fluid injection pressure at the injection well. Thereafter, the production well is opened and oil is recovered therefrom as the bottom-hole pressure declines. The throttled production cycle may be repeated at appropriate intervals during the process.

13 Claims, No Drawings

OIL RECOVERY METHOD

This is a continuation of copending application Ser. No. 261,824, filed May 8, 1981 (now abandoned).

BACKGROUND OF THE INVENTION

1. Field of the Invention

This invention relates to the recovery of oil from subterranean reservoirs, and more particularly to a new and improved thermal recovery process where the oil and gas production is alternately throttled at high and low rates.

2. Description of the Prior Art

In the recovery of petroleum crude oils from subterranean reservoirs, it usually is possible to recover only a minor portion of the oil originally in place in a reservoir by the so-called primary recovery methods, i.e., those methods which utilize only the natural forces present in the reservoir. Thus, a variety of supplemental recovery techniques have been employed in order to increase the recovery of oil from subterranean reservoirs. In these supplemental techniques which are commonly referred to as secondary recovery operations, although they may be primary or tertiary in sequence of employment, energy is supplied to the reservoir as a means of moving the oil in the reservoir to suitable production wells through which it may be withdrawn to the surface of the earth. Perhaps the most common secondary recovery processes are those in which displacing fluids such as water or gas are injected into an oil-bearing reservoir in order to displace the oil therein to suitable production wells. Other widely known secondary recovery or production stimulation processes are the so-called "huff and puff" gas injection techniques such as the procedure disclosed by U.S. Pat. No. 3,123,134 to J. R. Kyte et al. In this procedure, the reservoir typically is closed off to production and a suitable gas such as air, natural gas, combustion products, etc., is injected into the reservoir. Thereafter, gas injection is discontinued and the reservoir is placed on production through the wells used for gas-injection and/or additional production wells.

Another secondary recovery process which has shown promise is the concurrent or forward burn in-situ combustion technique. In this procedure, a portion of the reservoir oil is burned or oxidized in-situ to create a combustion front. This combustion front is advanced through the reservoir in the direction of one or more production wells by the injection of a combustion-supporting gas through one or more injection wells. The combustion front is preceded by a high temperature zone, commonly called a "retort zone," within which the reservoir oil is heated to effect a viscosity reduction and is subjected to distillation and cracking. Hydrocarbon fluids including the heated, relatively low viscosity oil and the distillation and cracking products of the oil then are displaced toward production wells where they are subsequently withdrawn to the surface of the earth. The in-situ combustion procedure is particularly useful in the recovery of thick, heavy oils such as viscous petroleum crude oils and the heavy, tar-like hydrocarbons present in tar sands. While these tar-like hydrocarbons may exist as solid or semi-solid materials in their native state, they undergo a sharp viscosity reduction upon heating and in the portion of the reservoir where the temperature has been increased by the in-situ combustion process behave like the more conventional petroleum crude oils.

In in-situ combustion oil recovery procedures, various techniques have been proposed which involve the manipulation of one or more production wells in the recovery pattern. These techniques typically are for the purpose of controlling the movement of the combustion front or the flow of fluids within the formation, particularly those fluids in the vicinity of the retort zone and combustion zone. Thus, in U.S. Pat. No. 2,390,770 to Barton et al., there is disclosed a procedure for controlling the movement of the combustion front by such procedures as throttling, to the extent if necessary of closing, a production well toward which the combustion front is preferentially moving and/or injecting various fluids such as drilling mud or water into such a well. Also, in U.S. Pat. No. 2,862,557 to van Utenhove et al. there is disclosed an in-situ combustion process in which gas is injected through a production well in order to bring about a pressure gradient reversal within the formation so as to force condensed products away from the production well into other portions of the formation.

A variation on the conventional in-situ combustion process in which the production well or wells are alternately throttled to effect an increase in oil recovery is disclosed in U.S. Pat. No. 3,434,541 to Cook et al.

More recently, an improved thermal method for recovering viscous petroleum has been disclosed in U.S. Pat. No. 4,127,172 to Redford et al. which utilizes the use of pressurization and drawdown cycles with the injection of thermal recovery fluids as a mixture of steam and an oxygen-containing gas. Pressurization of the formation, for example, may be accomplished by employing a higher injection rate than the production rate. Thereafter, drawdown, which is a reduction in formation pressure, may be accomplished by producing at a rate greater than the injection rate. In a later patent, U.S. Pat. No. 4,217,956 to Goss et al., an improvement in U.S. Pat. No. 4,127,172 is described wherein carbon dioxide is injected at the start of the pressurization cycle along with the injection of steam or a mixture of steam and an oxygen-containing gas.

SUMMARY OF THE INVENTION

The invention relates to an improved thermal method for recovering viscous oil from viscous oil-bearing reservoirs wherein pressurization and producing cycles are employed in combination with an in-situ combustion process using substantially pure oxygen or an oxygen-containing gas containing at least 75% by volume pure oxygen as the oxidant. In carrying out the invention, a combustion front is established in the reservoir and advanced through the reservoir in the direction of a production well by introducing a combustion-supporting gas comprising at least 75% volume pure oxygen through an injection well and oil is produced at the production well. The use of an oxygen-rich oxidant results in the formation of product gases containing high concentrations of carbon dioxide which is soluble in the reservoir oil thereby reducing its viscosity and improving its mobility. After an initial stage of in-situ combustion, the production well is partially choked or shut-in until the bottom-hole pressure thereof increases to a substantial fraction of the injection pressure, e.g., in the amount of about 30% to about 90% of the fluid injection pressure at the injection well. The production well then is opened to a lower back pressure level which results in an immediate acceleration of fluid flow under the resultant higher pressure gradient and experiences an increased rate of oil recovery. The pressurization and producing cycles may then be repeated using intervals found to be most effective for the particular system. In another embodiment of the invention, water or steam is injected simultaneously with, intermittently, or subsequent to injection of the combustion-supporting oxidant gas to enhance the performance of the process. In still another embodiment of the invention, mixtures of steam and carbon dioxide or mixtures of steam and low molecular weight $C_3$–$C_8$ hydrocarbons are injected into the oil-bearing reservoir and thereafter the cyclic steps of throttling the production well are employed as previously described.

DESCRIPTION OF THE PREFERRED EMBODIMENTS

The process of my invention is best applied to a subterranean, heavy oil-containing reservoir utilizing one or more production wells extending from the surface of the earth into the subterranean reservoir. The injection and production wells may be located and spaced from one another in any desired pattern or orientation. For example, the line drive pattern may be utilized in which a plurality of injection wells and a plurality of production wells are arranged in rows which are spaced from one another. Exemplary of other patterns which may be used are those wherein a plurality of production wells are spaced about a central injection well, or conversely, a plurality of injection wells spaced about a central producing well. Typical of such well arrays are the five-spot, seven-spot, nine-spot, and thirteen-spot patterns. The above and other patterns for effecting secondary recovery operations are well known to those skilled in the art.

For the purpose of simplicity in describing the invention, reference sometimes will be made herein to only one injection well and one production well in a recovery pattern. However, it will be recognized that in practical applications of the invention a plurality of such wells, particularly the production wells, may be and in most cases will be utilized.

In practicing the invention, an oxidant comprising an oxygen-containing gas containing at least 75% pure oxygen and preferably substantially pure oxygen, is injected into the formation via an injection well and combustion of a portion of the in-place oil adjacent the well is initiated. Injection of the oxygen-rich oxidant is continued, thereby establishing a combustion front and generation of hot gaseous combustion products containing high concentrations of carbon dioxide. As the combustion front advances through the reservoir in the direction of the producing well, the gaseous combustion products righ in carbon dioxide and water are driven through the reservoir ahead of the combustion front and the retort zone. In this area, the reservoir oil undergoes distillation and/or cracking in the vicinity of the retort zone and the distillation and cracking products are driven ahead of the combustion zone, also functioning as heating and displacing fluids. In addition, the combustion gases heat the oil thus effecting a further viscosity reduction and drive the oil through the reservoir toward the production well where it is recovered. Still farther down stream from the combustion front and retort zone, the reservoir oil which has not yet been subject to the heating process is contacted by combustion products, in particular the carbon dioxide which partially dissolves in the reservoir oil reducing its viscosity and thereby improving its mobility.

During the initial phase of the combustion drive, the production well is operated in a conventional manner to recover oil from the reservoir. At a suitable stage of the process, a pressurization cycle is initiated by throttling or choking the production well sufficiently until the pressure of the fluids in the reservoir and particularly the fluids in the proximity of the well penetrating the reservoir has increased to an amount of about 30% to about 90% of the fluid injection pressure at the injection well. The pressure in the reservoir immediately surrounding the penetrating well commonly is termed the "bottom-hole pressure" of the well and will be so designated in the description and in the appended claims. The production well may be throttled sufficiently to completely shut it in such that no fluid production from the well is obtained during the time that the bottom-hole pressure is being increased. Alternately, the production well may be operated during this step at a reduced production rate so long as it is choked sufficiently to effect at least the desired bottom-hole pressure increase.

As the bottom-hole pressure of the production well increases, a corresponding pressure increase takes place within the reservoir. In response to the pressure increase, carbon dioxide and other gases produced from the in-situ combustion process become more soluble in the oil phase. For a period, oil will continue to flow through the formation toward the production well, although at a continually decreasing rate, to fill the space previously occupied by the undissolved gaseous components.

After the production well has remained choked for the desired period of time, depending upon pattern size, rate of injection and fluid production characteristics, it is opened to a lower back pressure level to cause an immediate acceleration of fluid flow under the resultant higher pressure gradient. The flow rate of produced fluids will be much greater than realized under the earlier sustained flow conditions at the same (constant) and usually quite low back pressure because the gas phase saturation has been reduced and the oil phase containing dissolved carbon dioxide, is of lower viscosity. Also, because of the higher dissolved carbon dioxide content and other gaseous components, the extent of "solution gas drive," the expulsion of oil through reservoir rock pores by the dissolved gas evolving from the oil phase under reduced pressure, is markedly increased for the period during which local pressures around the well bore are diminshed. This cyclic operation offers well stimulation advantages similar to those described in the technical paper by J. T. Patton and K. H. Coats entitled "Parametric Study of the $CO_2$ Huf-n-Puf Process," Society of Petroleum Engineers 9228, presented at the 54th Annual Meeting in Las Vegas, Sept. 23, 1979, but does not impose the need for actually injecting carbon dioxide intermittently into a producing well since the enriched oxygen combustion process provides the oil soluble gas. Eventually, a sustained flow rate will again be established comparable to that before the shut-in or throttling operation was imposed. However, it is to be recognized that the overall oil recovery is enhanced in that the total production of the shut in or throttled period plus the depressurizing period will exceed that for the same period with no throttling or shut in imposed. Further, with a recovery process using thermal energy, an advantage is also gained during the shut in period wherein the heat generated by combustion may be convected (thermally and gravitationally) in a vertical direction by steam/water and other gases as well as horizontally by the injected fluids and the products of these fluids along with oil and other components being displaced horizontally. The latter condition applies to those applications wherein the flow through the reservoir is generally horizontal, but does not limit use of the procedure in applications where the flow involving displacement of reservoir fluid also has a major vertical component.

Another advantage related to the thermal conditions of the process results from the higher pressure (shut in) period having a higher steam temperature for condensation and release of latent heat to the surrounding environment (e.g., rock and heavy oil). This higher temperature favors heavy oil pyrolysis or cracking to a more mobile hydrocarbon which further enhances its recovery and upgrading. Upon depressuring, the condensed water phase, like dissolved carbon dioxide, flashes to the vapor state and augments the solution gas drive mechanism. This causes the condensing gas phases, i.e., carbon dioxide, steam, and hydrocarbon, to penetrate portions of the reservoir that were previously unswept and to effect subsequent displacement of the oil during the pressure reduction phase of the cycle. By this cyclic behavior, the sweep of the reservoir subject to the process is increased and overall recovery improved. The produced liquids and gases may be removed from the production well either by multiphase flow to surface facilities through well tubing or casing or through use of downhole pumps to remove liquids from the well and allowing separated gases to flow up the pump tubing-casing annulus or through an additional tubing arrangement to a surface recovery system. If desired, produced carbon dioxide or other gases may be separated, recompressed, and injected into the same or other reservoirs to enhance the recovery of hydrocarbons therefrom.

The combustion-supporting gas consisting of at least 75% by volume pure oxygen and preferably substantially pure oxygen is continuously injected via the injection well during cyclic manipulation of the production well in accordance with the present invention. This aids in the maintenance of a significant pressure gradient extending through the reservoir from the injection well to the production well with the attendant beneficial results noted hereinbefore. This does not preclude the discontinuance or marked reduction in rate of oxygen injection and fluid production from the producing wells for some period of time during the course of the recovery operation to permit a "soaking" or redistribution of heat within the reservoir which would subsequently enhance the performance of the recovery process when production and injection were resumed.

The periodic steps of choking the well and thereafter opening it to production may be repeated at appropriate intervals during the combustion drive until oil recovery becomes uneconomical. The optimum repetitive frequency of these steps will vary from reservoir to reservoir and from well to well, depending upon many factors such as size and volume of the reservoir affected, fluid injection rates, pressure level and range of pressure variation in cyclic operation, permeability of the reservoir and fluid mobilities. The optimum combination of choking or shut-in to producing periods can be determined for any given set of operating conditions. In general, the preferred producing period may be expected to be equal to or greater than the shut-in or choked period.

The maximum pressure level which the producing well may be allowed to reach during the shut-in or throttled production period will also vary according to reservoir size affected and the operating conditions. However, if $P_i$ is the oxidant injection pressure and $P_o$ is the producing well pressure subject to the cyclic operating conditions, a practical upper limit on $P_o$ during the shut-in period may be expected to be in the range of about 0.9 $P_i$, higher pressures perhaps causing flow of fluids from one operating pattern to another, particularly if adjoining patterns were not being operated in phase with each other. The lower limit of producing well pressure, $P_o$, which would occur during the "blowdown" or producing phase of the cycle may be as low as can be efficiently practiced with the fluid producing system being used. Studies of cyclic well stimulation by carbon dioxide injection in accordance with the SPE 9228 article previously noted indicate no advantage to be gained by not using the maximum drawdown (low $P_o$) consistent with other operating pressure requirements.

In a slightly different preferred embodiment of the process of my invention, water or steam is injected simultaneously, intermittently, or following the combustion-supporting oxidant gas so as to enhance the performance of the process by further heating of the viscous oil in the reservoir. During the in-situ combustion heating phase, the advancing combustion front leaves behind a large amount of heated reservoir rock and the introduction of water or steam contributes effectively to scavenging this heat and carrying it forward (as steam sensible and latent heat) to a region in the reservoir where prevailing temperature and pressure causes the steam to condense and release the latent heat to the reservoir rock thereby reducing the viscosity of the oil and improving its mobility. Because of the high latent heat content of the steam, it provides a highly effective carrier of energy from the heated to the unheated parts of the reservoir. The cyclic throttling operation previously described will also cause steam-water condensation to be affected. For example, when the producing well pressure is increased during the proposed throttling action, the flowing steam (water vapor) will encounter pressure temperature conditions that will favor condensation and release of latent heat. Upon depressurizing, howevever, water will flash to steam with a major volumetric expansion and displacement of oil and other reservoir fluids. This creates additional pore space that is gas filled, thereby enhancing the amount of oil and other reservoir fluids that can invade the same reservoir volume element during the next pressure cycle caused by choking the production well.

The amount of water or steam injected into the reservoir will vary according to the amount of fuel deposited and the stage of the combustion operation, that is, how much of the reservoir has been subjected to a burn frontal movement. Thus, if the water or steam is injected simultaneously with the injected combustion-supporting gas at the initiation of in-situ combustion, the amount injected must not be so great, of course, as to extinguish the combustion as would be evidenced by the composition of the gases produced from the reservoir. In this embodiment, the preferred amount of water is up to about 2.5 barrels per MSCF of pure oxygen in the oxygen-containing gas injected via the injection well and the preferred amount of steam is up to about 5.0 barrels per MSCF of pure oxygen in the oxygen-containing gas. In the case of injecting the water or steam into the reservoir after the combustion front has travelled a considerable distance into the reservoir, a much greater amount of heated rock is left behind and therefore a greater amount of water or steam can be used to scavenge this heat so as to improve the distribution of heat generated by the process. The amount of water or steam injected after the combustion front has advanced into the reservoir will depend upon how much heat has been introduced when injection is initiated and also upon particular characteristics of the reservoir such as permeability, water content, fluid mobilities, etc.

In another embodiment of this invention, the proposed cyclic producing schedule of the present invention is employed in a subterranean oil-bearing reservoir subjected to a variation in a conventional steam flood thermal recovery method. In this embodiment, a condensible gas such as carbon dioxide or a low molecular weight hydrocarbon solvent having from 3 to 8 carbon atoms in the molecule is injected intermittently or along with steam into the reservoir via the injection well and after an initial stage of injection the production well is choked and subsequently produced in accordance with the proposed invention as previously described. The volatile solvent, e.g., carbon dioxide or hydrocarbon solvent, will flow through the steamed zone of the reservoir and condense downstream of the steam front dissolving in the oil being displaced and effectively reduce its viscosity. When injecting a mixture of carbon dioxide and steam, the preferred amount of steam and carbon dioxide is in a ratio of up to about 200 MSCF of carbon dioxide per barrel of steam. Having achieved this state, the proposed steam flood is seen to be similar to the previously described oxygen-to-carbon dioxide combustion embodiment and accordingly it should be expected to respond favorably to the cyclic producing well schedule of the present invention as previously described in detail.

I claim:

1. In a method for recovering viscous oil from an oil-bearing subterranean reservoir penetrated by an injection well and a production well, the method comprising:

(a) injecting an oxygen-containing gas comprising at least 75% by volume pure oxygen through said injection well into said reservoir;

(b) igniting oil in said reservoir adjacent said injection well to form a combustion front and to generate hot combustion gases containing a large concentration of carbon dioxide;

(c) continuing to inject said oxygen-containing gas through said injection well to advance said combustion front and oil displacing gases through the reservoir toward said production well;

(d) recovering oil from said reservoir through said production well;

(e) throttling fluid flow from said production well and continuing injection of said oxygen-containing gas without interrupting the injection rate until the bottom-hole pressure of said production well has increased to a desired pressure level; and (f) opening said production well and recovering oil therefrom as the bottom-hole pressure of said well declines without interrupting the injection rate of the oxygen-containing gas.

2. The method of claim 1 wherein said production well is choked in step (e) until the bottom-hole pressure of said production well has increased to an amount of about 30% to about 90% of the fluid injection pressure at the injection well during step (c).

3. The method of claim 1 wherein said oxygen-containing gas is substantially pure oxygen.

4. The method of claim 1 wherein said well is shut-in during step (e).

5. The method of claim 1 further comprising repeating steps (e) and (f) for a plurality of cycles.

6. The method of claim 1 further comprising injecting water simultaneously with said oxygen-containing gas during step (c), the amount of water so injected being up to about 2.5 barrels of water per MSCF of pure oxygen in said oxygen-containing gas.

7. The method of claim 6 wherein the injection of said water is periodically terminated.

8. The method of claim 1 further comprising injecting steam simultaneously with said oxygen-containing gas during step (c), the amount of steam so injected being up to about 5.0 barrels to steam per MSCF of pure oxygen in said oxygen-containing gas.

9. The method of claim 8 wherein the injection of said steam is periodically terminated.

10. The method of claim 1 further comprising the additional step of injecting a fluid via said injection well into the burned out region of said reservoir after the combustion front has traveled a desired distance between the injection well and the production well to scavenge heat from the depleted portion of the reservoir and assist recovery of oil from the reservoir into said production well.

11. The method of claim 10 wherein said fluid is water.

12. The method of claim 10 wherein said fluid is steam.

13. The method of claim 10 wherein injection of the said fluid is periodically terminated.

* * * * *